US008979720B2

(12) United States Patent
Brentham et al.

(10) Patent No.: US 8,979,720 B2
(45) Date of Patent: Mar. 17, 2015

(54) STRENGTH AND BALANCE EXERCISE APPARATUS

(75) Inventors: Jerry D. Brentham, Belton, TX (US); Brent E. Brentham, Belton, TX (US)

(73) Assignee: Surge Performance Training LLC, Austin, TX (US)

( * ) Notice: Subject to any disclaimer, the term of this patent is extended or adjusted under 35 U.S.C. 154(b) by 110 days.

(21) Appl. No.: 13/153,591

(22) Filed: Jun. 6, 2011

(65) Prior Publication Data

US 2012/0309598 A1 Dec. 6, 2012

(51) Int. Cl.
*A63B 21/008* (2006.01)
*A63B 21/00* (2006.01)

(52) U.S. Cl.
CPC ..... *A63B 21/1469* (2013.01); *A63B 21/0083* (2013.01); *A63B 21/1492* (2013.01); *A63B 2208/0204* (2013.01)
USPC ..... 482/112

(58) Field of Classification Search
USPC ..... 482/92, 110–113, 62, 79–80, 130
See application file for complete search history.

(56) References Cited

U.S. PATENT DOCUMENTS

| | | | | |
|---|---|---|---|---|
| 3,421,760 | A * | 1/1969 | Freeman, Jr | 482/80 |
| 3,587,319 | A * | 6/1971 | Andrews | 482/112 |
| 4,185,818 | A | 1/1980 | Brentham | |
| 4,291,787 | A | 9/1981 | Brentham | |
| 4,605,220 | A * | 8/1986 | Troxel | 482/79 |
| 5,178,160 | A * | 1/1993 | Gracovetsky et al. | 600/595 |
| 5,372,564 | A * | 12/1994 | Spirito | 482/112 |
| 5,803,874 | A | 9/1998 | Wilkinson | |
| 6,935,991 | B1 * | 8/2005 | Mangino | 482/51 |
| 7,704,199 | B2 | 4/2010 | Koch et al. | |
| 7,878,956 | B2 | 2/2011 | Kadar et al. | |
| 7,892,154 | B1 * | 2/2011 | Alexa | 482/112 |
| 8,137,249 | B2 | 3/2012 | Koch et al. | |
| 8,500,612 | B2 | 8/2013 | Koch et al. | |
| 2007/0179027 | A1 | 8/2007 | Van Straaten | |
| 2008/0234116 | A1 * | 9/2008 | Elzerman | 482/123 |
| 2009/0286659 | A1 | 11/2009 | Brown | |
| 2010/0167887 | A1 | 7/2010 | Berry | |

OTHER PUBLICATIONS

PCT/US2012/041110 International Search Report.
WPCT/US2012/041110 Written Opinion.
International Preliminary Report on Patentability dated Dec. 27, 2013 for Application No. PCT/US2012/041110.

* cited by examiner

*Primary Examiner* — Loan H Thanh
*Assistant Examiner* — Jennifer M Deichl
(74) *Attorney, Agent, or Firm* — Meyertons, Hood, Kivlin, Kowert & Goetzel, P.C.

(57) ABSTRACT

A strength and balance exercise apparatus is provided having a pair of exercise arms pivotally supported from the floor. Each arm has handgrips for grasping and manipulation of the arm by the user. A passive force generating means, in this case, double-acting hydraulic cylinders are connected between the floor and the exercise arms to resist movement of the arms. According to the method, the user grasps the handgrips and manipulates the arms to get slow resistance of the passive force generating means while maintaining balance in a standing position.

19 Claims, 6 Drawing Sheets

STRENGTH AND BALANCE EXERCISE APPARATUS

BACKGROUND

Technical Field

The present inventions relate to exercise devices for use by a person to strengthen and rehabilitate muscles and to improve stamina and balance. In particular, the present inventions relate to an exercise device of the type in which the user grasps hand grips and manipulates portions of the device against the resistance of double-acting hydraulic cylinders while maintaining balance in a standing position.

Many specialized exercise devices exist, however none have effectively utilized the full potential of stressing various muscles in different directions throughout movement while requiring the user to maintain balance.

SUMMARY OF THE INVENTIONS

However, the present inventions provide for stressing in different directions which allows the user to dictate the specific muscle group exercised and at what rate. Using double-acting hydraulic cylinders to provide resistance, gives the user the advantages of variable resistance and variable speed of movement. Providing for use of the hands to grasp hand grips on two independent resisting portions of the apparatus thereby creates the stabilizing effect of the opposing muscles groups which will create and improve balance.

In the exercise apparatus of the present inventions, muscle groups are not pitted against forces generated by springs, rubber bands, weights and the like. Instead, the apparatus utilizes devices which create forces which primarily resist movement, and the resistance is increased with speed of movement.

As used herein, the words "comprise," "have," "include," and all grammatical variations thereof are each intended to have an open, non-limiting meaning that does not exclude additional elements or steps. As used herein, "movement resisting means" refers to a device that applies a force only during movement of an object. As used herein, the term "arm" is used to refer to an elongated rigid member having no particular size or shape. Also as used herein, the term "piston" is intended to refer to an object located in a chamber containing fluid and is of no particular shape or size and is not required to include seals, packing, cups or the like.

BRIEF DESCRIPTION OF THE DRAWINGS

The drawings are incorporated into and form a part of the specification to illustrate at least one embodiment and example of the present inventions. Together with the written description, the drawings serve to explain the principals of the inventions. The drawings are only for the purpose of illustrating at least one preferred example of at least one embodiment of the inventions and are not to be construed as limiting the inventions to only the illustrated and described example or examples. The various advantages and features of the various embodiments of the present inventions will be apparent from a consideration of the drawing in which.

DETAILED DESCRIPTION OF THE INVENTIONS

Figure 1:
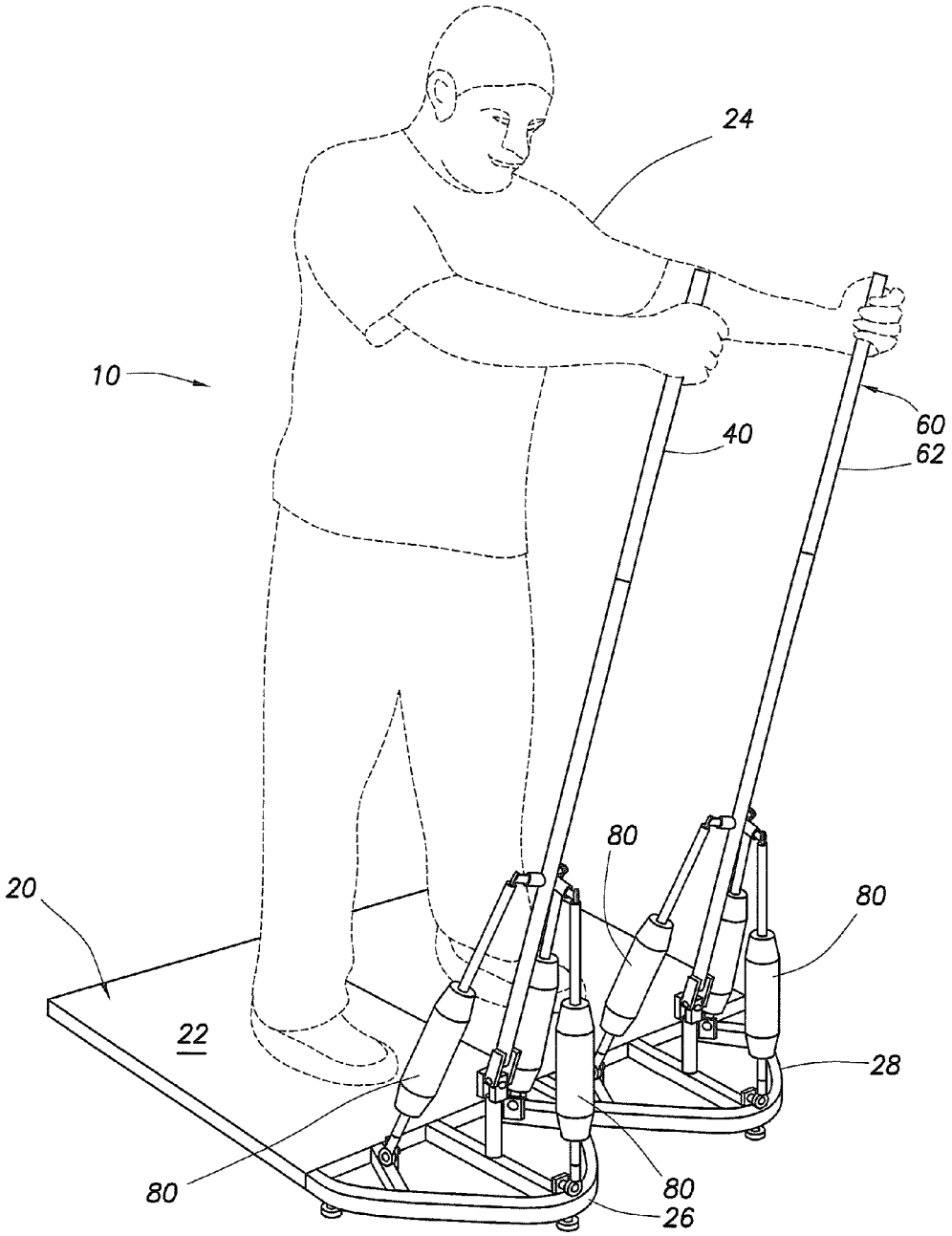
FIG. 1 is a perspective view of one embodiment of the Strength and Balance Exercise Apparatus of the present inventions.

Referring now to the drawings wherein like reference characters refer to like or corresponding parts throughout the several figures, there is illustrated in FIG. 1 a Strength and Balance Exercise Apparatus which for purposes of description is generally identified by reference numeral 10. The exercise apparatus 10 generally comprises three subparts, a base 20 and a pair of arms 40 and 60 for use in exercising. As illustrated in FIG. 1, the base 20 comprises a horizontal surface 22 on which the user 24 stands and a pair of arm mounting bases 26 and 28. In this particular embodiment, the horizontal surface 22 is formed by a rectangular metallic plate. The arm mounting bases 26 and 28 are formed by a plurality of metallic beams which are welded to the edge of the rectangular metallic plate. It is envisioned of course that the arm mounting bases 26 and 20 could be anchored to the floor, eliminating the need for a rectangular metallic plate and allowing the floor itself to act as a horizontal surface 22 on which the user 24 stands when using the apparatus.

As can be seen in FIG. 1, each of the exercise arms 40 and 60 comprises an elongated rigid member with handgrips 42 and 62, respectively, for grasping by the user 24. As will be explained in more detail, the arms 40 and 60 are movably connected to the arm mounting bases 26 and 28, respectively, such that the arms can be moved in the any direction. In other words, each of the exercise arms 40 and 60 can be moved forward, backward and side-to-side while being grasped by the handgrips 42 and 62. It should be appreciated that the handgrips 42 and 62 need not be configured as such that they are parallel to are aligned with the connection of the arms 40 and 60 to the base. Alternatively, it is envisioned that these handgrips could extend transversely to the length of the arms 40 and 60. Also, as will be hereinafter explained in more detail, movement resisting means in the form of three double-acting hydraulic cylinders 80 are pivotally attached between each of the arms and the base to provide resistance forces opposing movement and manipulation of the arms by user.

The telescoping hydraulic cylinders 80 can comprise two-way fluid resistive cylinders, such as, standard motorcycle racing shock absorbers. The shocks can provide some incidental spring force but must primarily apply forces only to resist movement. Alternatively, they can be of the type described in the U.S. Pat. No. 4,291,787 which is incorporated herein by reference in its entirety for all purposes. These hydraulic cylinders comprise a body having a cavity of chamber containing fluid and a piston reciprocally mounted in the chamber. The fluid can be, for example, hydraulic oil, silicone or the like. The piston is turn connects to a rod which telescopes into and out of the hydraulic cylinder with relative movement between the body and rod. Internal openings or passageways in the hydraulic cylinder allow fluids to flow by or through the piston or to be pumped around the piston to provide resistance as the cylinder telescopes and un-telescopes. The basic principle of its operation is to use the piston's relative movement to flow fluids through an opening, orifice, passageway or the like to provide a passive resistance against telescoping and un-telescoping the cylinder. In the patented '787 embodiment, flow and the resistance can be adjusted. Telescoping hydraulic cylinders are passive structural elements, in the sense that they do not apply forces to the exercise arms, and only resist (apply a force opposing) any telescoping movement. Further, the amount of resistance applied by the hydraulic cylinder varies depending upon the speed or of telescoping movement. As the speed increases, the resisting force applied by the hydraulic cylinders increase. It is to be understood, of course, that even when the fluids in the chamber flow through an opening in the piston, fluid is being flowed and pumped. It is also envisioned that forces resisting movement could be created by moving other objects relative to a fluid, such as vanes or the like. Therefore, as the user increases the pivot speed of the arms, the amount of the resisting the force increases. As the user slows, the rate of pivoting the arms, the opposing or resisting force decreases.

To use the exercise apparatus 10, the user stands on the horizontal surface 22 while grasping the handgrips 42 and 62 on the arms 40 and 60. While maintaining balance, the user exercises by pulling and pushing the arms 40 and 60. As the arms are moved, the hydraulic cylinders 80 are telescoped, providing resistance to it each arm's movement. As can be appreciated, to maintain balance opposing muscles in the upper body must be utilized as well as muscles in the core and lower torso. According to a particular feature of the exercise apparatus 10 of the present inventions, the arms 40 and 60 can be used in any direction, permitting exercise of a variety of muscle groups. By varying the speed of movement of the exercise, a resistance level can be increased or reduced. The directional and speed flexibility of the exercise apparatus 10 allows the user to dictate which specific angle a muscle group is being exercised and at what rate. By moving the arms 40 and 60 in a series of accelerations and decelerations, human body competition can be mimicked.

Figure 2:
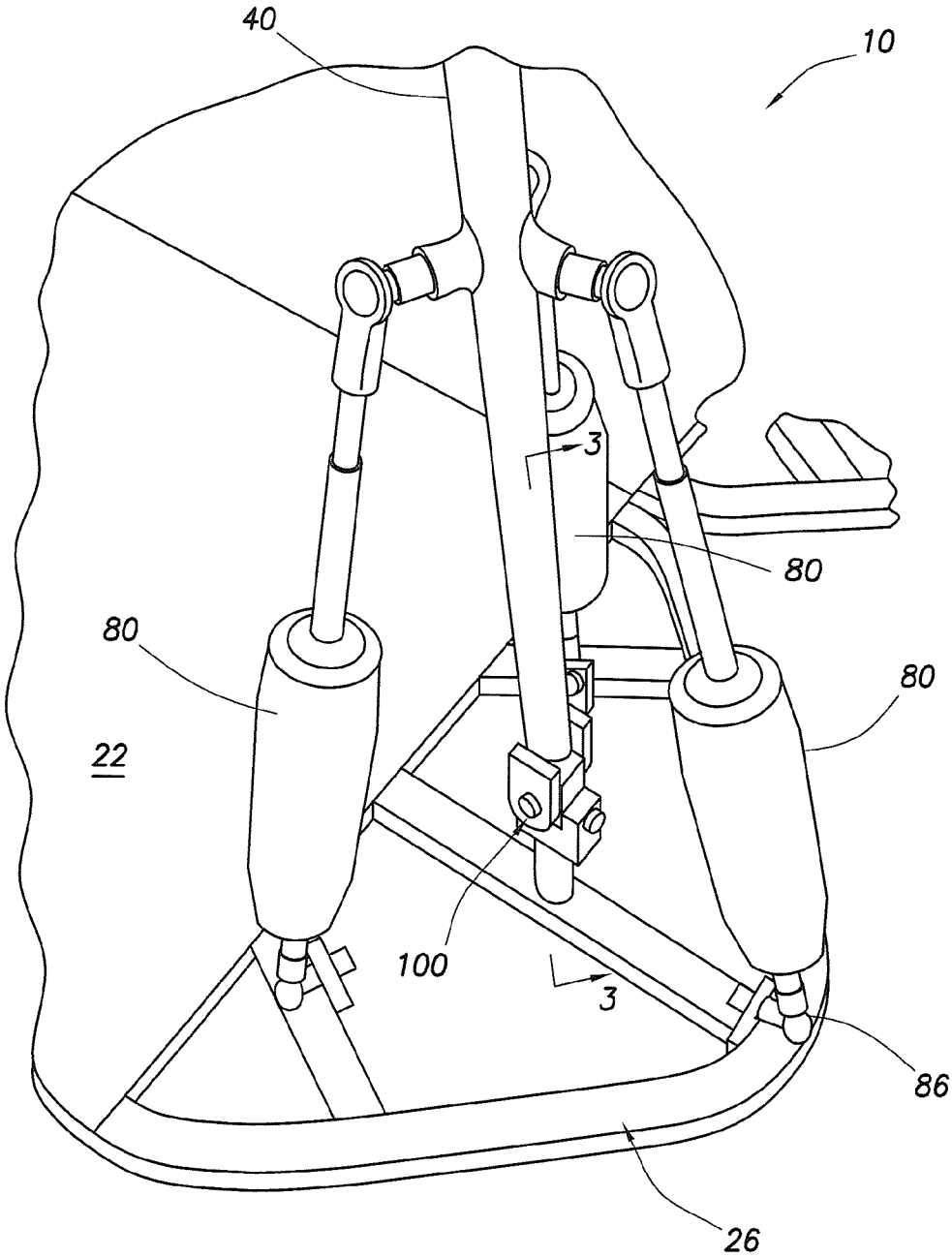
FIG. 2 is a partial, enlarged perspective view of the embodiment of FIG. 1.
Figure 3:
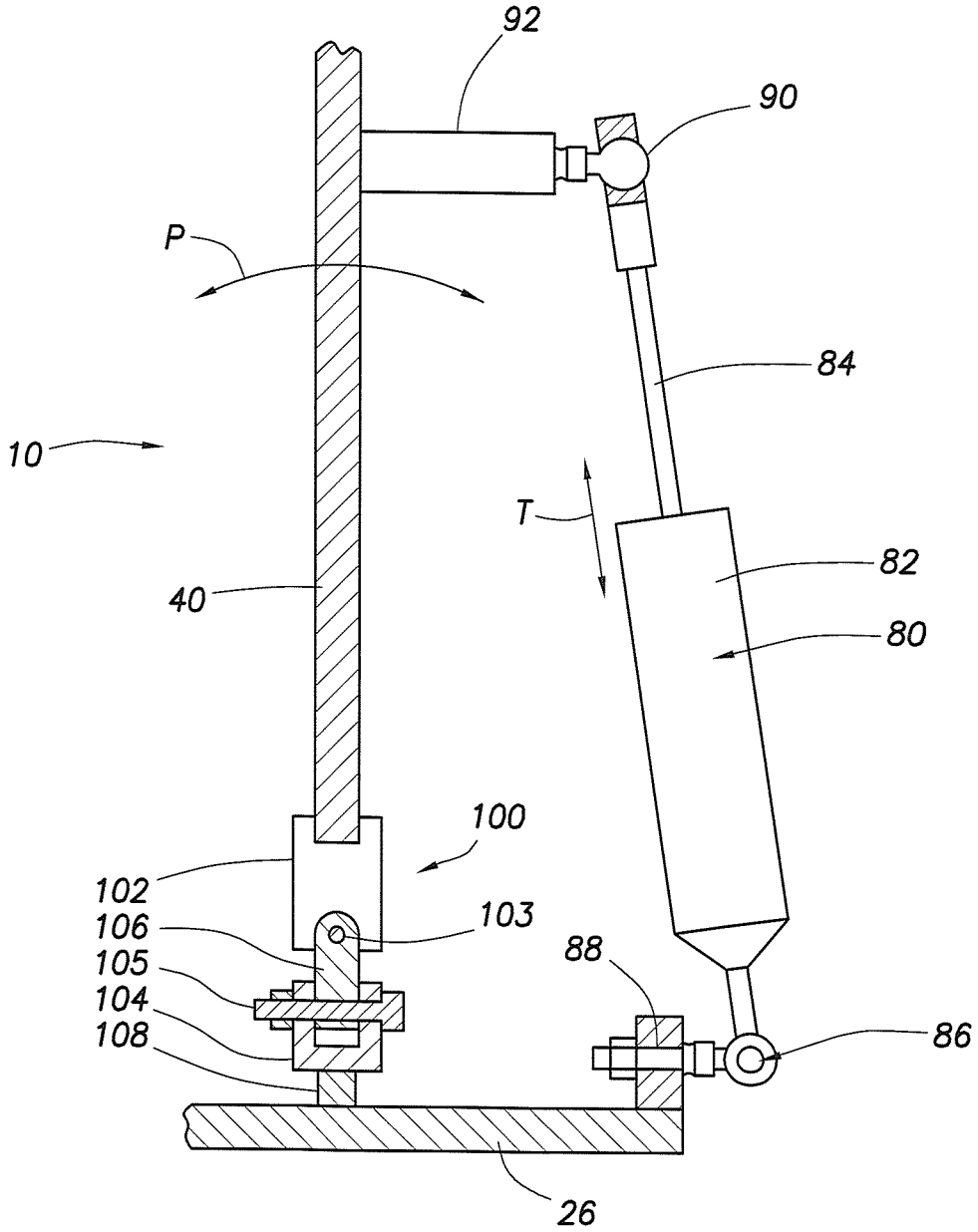
FIG. 3 is a partial sectional view of the embodiment of FIGS. 1 and 2 taken along line 3-3 in FIG. 2, looking in the direction of the arrows.
Figure 6:
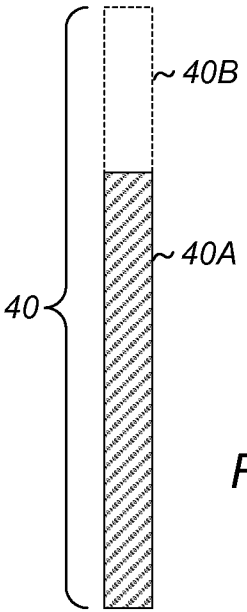
Figure 5:
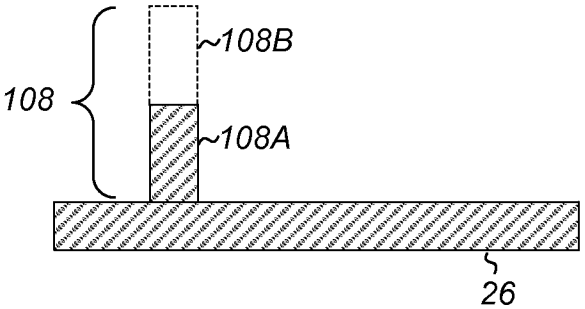
Figure 7B:
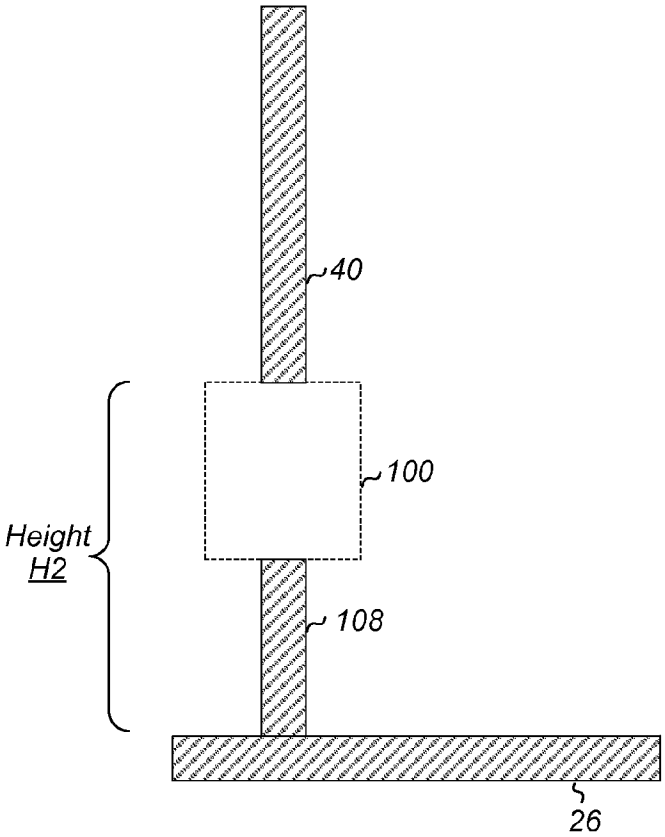
Figure 7A:
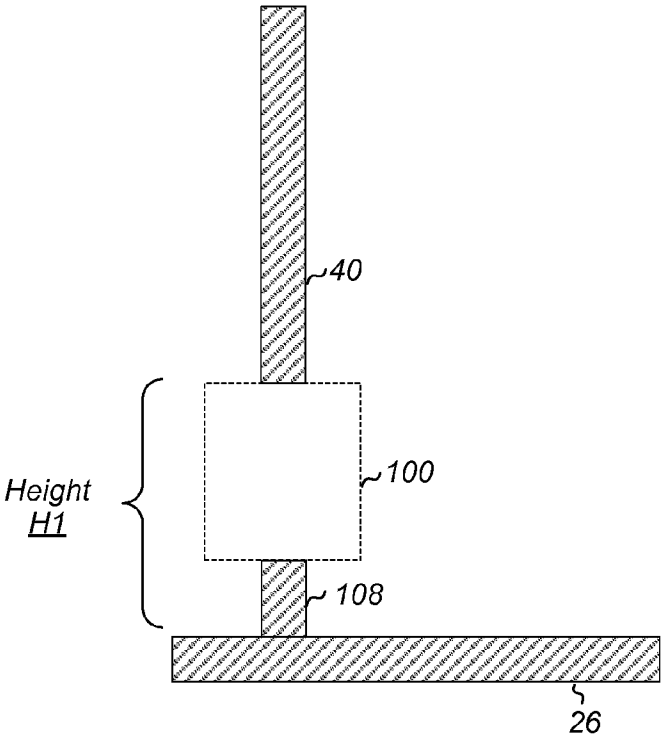

Referring now to FIGS. 2 and 3, the typical connection of the arms 40 and 60 and cylinders 80 to the base 20 will be described in detail. The mounting for each of the arms 40 and 60 are identical. Functionally, arms 40 and 60 are pivotally connected to the base 20 so that the arms can be attributed in any direction. In the FIG. 2 embodiment, arm 40 is connected by universal joint 100 to the base portion 26. The universal joint 100 comprises a bifurcated portion 102 fixed to the lower end of the arm 40 and a second bifurcated portion 104 supported from the base 26 to extend upward therefrom. Idler block 106 is pivotally connected to each of the bifurcated portions 102 and 104, by pivot shafts 103 and 105, respectively. As illustrated, the lower bifurcated portion is 104 is supported above the base by a spacer 108. In the preferred embodiment, spacers 108 elevate the bifurcated portions 104 and pivot shaft 105 a short distance above the surface on which the user stands. It is appreciated, of course, that the spacers 108 for each arm could be longer to elevate the bifurcated portions 104 and pivot shaft 105 substantially more. The universal joint 100 allows each arm to be moved back and forth and side to side by the user or, in other words, the arms can be moved in 360°. It is envisioned, of course, that other pivotal mountings could be used such as a ball joint wherein the arms 40 and 60 are connected to a ball enclosed in a socket attached to the base 20. Or conversely, balls could be supported from the base and a socket attached to the end of each arm. In addition, it should be appreciated that the arms 40 and 60 could be adjustable in length to accommodate users of different heights. Similarly, the height of the spacers 108 could be adjustable to elevate or lower the arms 40 and 60 to a convenient user level. In FIG. 5, a spacer 108 is shown attached to base 26, similar to FIG. 3. In this embodiment, as noted above, the height of spacer 108 may be adjusted. Thus, in FIG. 5, spacer 108 includes a first portion 108A and a second portion 108B (which may be raised or lowered to achieve a different total height for spacer 108, as would be understood by one of skill in the art in view of the disclosure above). In FIG. 6, arm 40 is shown as including a first portion 40A and a second portion 40B (which may be raised or lowered to achieve a different height for arm 40, as would be understood by one of skill in the art in view of the disclosure above). In FIGS. 7A and 7B, two arms 40 are shown as having different elevations H1 and H2 above base 26 at which respective arms 40 are coupled to a universal joint 100 (which may be as described relative to FIG. 3 in this embodiment).

A typical mounting for the hydraulic cylinders 80 is illustrated in detail in FIGS. 2 and 3. For purposes of description, the hydraulic cylinders 80 are divided into a cylinder portion 82 and a rod portion 84. During use, the rod portion 84 telescopes into and out of the cylinder portion 82, thus shortening and lengthening the cylinder 80 as shown by arrows T. The cylinder portion 82 contains a piston mounted to reciprocate in a chamber in the cylindrical portion, not shown. Typically, fluid is in the chamber. In the position illustrated in FIG. 3, the piston would typically be located midpoint the axial length of the cylinder, allowing hydraulic cylinder 80 to be telescoped inward and outward as the arms 40 moves. A ball joint assembly 86 is connected to the lower end of the cylinder portion 82. The ball joint assembly is connected in to an upstanding member 88 fixed to base 26. The ball joint assembly 86 allows the lower end of the piston to pivot with respect to the base 26.

Each of the hydraulic cylinders 80 are pivotally connected between the base at 26 and arms 40 by ball joint assemblies. The cylinder portion 82 is provided with a seal (not shown) around the rod portion 84 to maintain the fluid in the chamber as the rod telescopes and un-telescopes. A ball joint assembly 90 is attached to the extending end of the rod portion 84. The ball joint assembly 90 is, in turn, connected to a member 92 fixed to exercise arms 40 at a point spaced away from the bifurcated portion 102. It will be appreciated that as the arm 40 pivots in the direction of the arrow P the hydraulic cylinder 80 will be forced to telescope and un-telescope and create a resistance against movement or pivoting of the arms 40. As explained, when movement of the exercise arms 40 and 60 is halted, no forces are exerted on the arms by the hydraulic cylinders 80.

Figure 4:
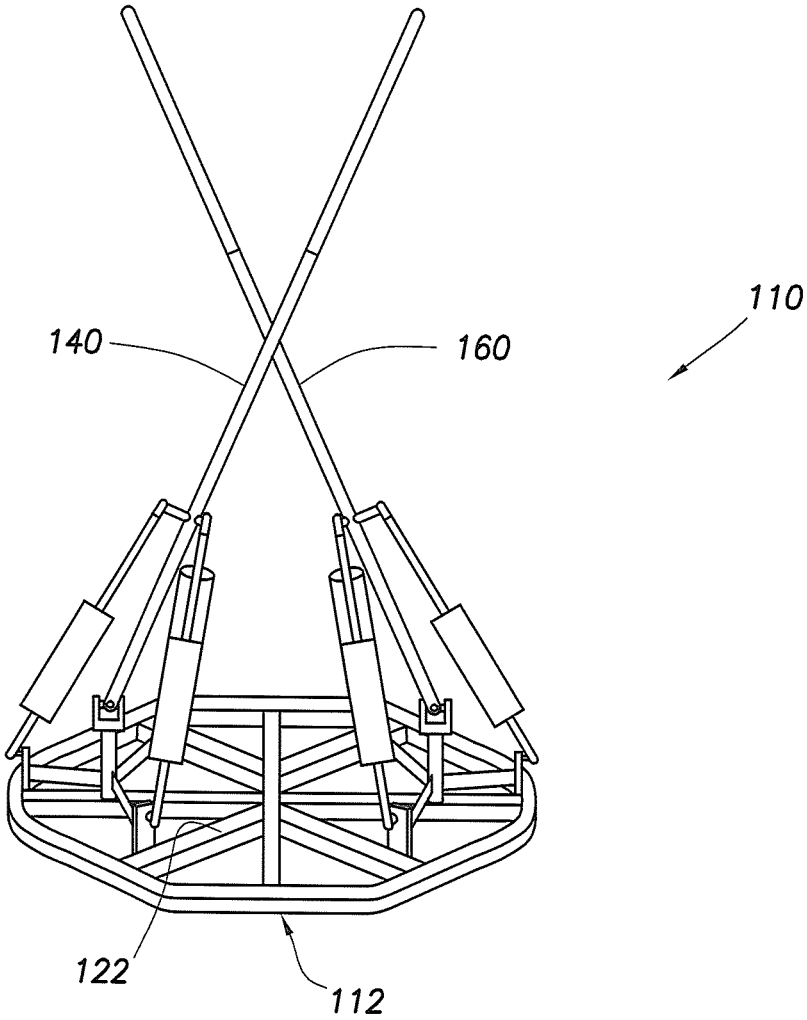
FIG. 4 is a perspective view similar to FIG. 1 illustrating an alternative embodiment of the Strength and Balance Exercise Apparatus of the present inventions.

An alternative embodiment of the strength and balance exercise apparatus is illustrated in FIG. 4 and for purposes of description is generally identified by reference numeral 110. In this particular embodiment, the base 112 is circular and provides a horizontal surface 122 for the user 24 to stand in the center portion of the base 112. It is to be appreciated that the surface 122 is located between the exercise arm assemblies identified in FIG. 4 by reference numerals 140 and 160. Whereas the manipulation of the arms 40 and 60 in the embodiment illustrated in FIG. 1 was primarily to the front and side of the user 24, in the FIG. 4 embodiment with the user centered between the arms, manipulation of the arms 140 and 160 is expected to the front, sides and rear of the user.

Therefore, the present inventions are well adapted to attain the ends and advantages mentioned as well as those that are inherent therein. The particular embodiments disclosed herein are illustrative only, as the present inventions may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified, and all such variations are considered within the scope and spirit of the present inventions.

While structure and methods are described in terms of "comprising," "containing," or "including" various components or steps, the compositions and methods also can "consist essentially of" or "consist of" the various components and steps.

Also, the terms in the claims have their plain, ordinary meaning unless otherwise explicitly and clearly defined by the patentee. Moreover, the indefinite articles "a" or "an", as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. An exercise apparatus adapted to be operated by a user, comprising, a base forming a surface upon which the user can stand;

a pair of coupling mechanisms, each comprising a vertical element connected to and extending upward from the base;

a pair of universal joints, wherein each of the pair of universal joints is entirely elevated above the base by being connected to the vertical element of a respective one of the pair of coupling mechanisms;

a pair of independently movable arms, each arm being elongated in a vertical direction relative to the base and comprising a graspable elongated element that is positioned above the base, each arm being connected to a respective one of the pair of universal joints, wherein each of the pair of universal joints is configured to pivot horizontally in all directions with respect to the base; and respective pluralities of resistance devices coupled between each arm and the base, wherein each of the respective pluralities of resistance devices is configured to provide a force resisting pivotal movement of its respective arm in any horizontal direction relative to the base; and wherein each arm is coupled to a respective one of the pair of universal joints at a first respective elevation above the base that allows that arm to pivot at the first respective elevation, wherein the first respective elevation is higher than another elevation at which the respective plurality of resistance devices for that arm are coupled to the base.

2. The exercise apparatus of claim 1, wherein each of the arms comprises handgrips for grasping by the user.

3. The exercise apparatus of claim 1, wherein each of the respective pluralities of resistances devices coupled between each arm and the base comprises telescoping cylinders.

4. The exercise apparatus of claim 3, additionally comprising a ball joint connecting each of the telescoping cylinders to the arms.

5. The exercise apparatus of claim 3, additionally comprising a ball joint connecting each of the telescoping cylinders to the base.

6. The exercise apparatus of claim 3, wherein each of the telescoping cylinders comprises a body forming a cavity therein, a piston member movably enclosed in the cavity, fluid in the cavity and a rod connected to the piston extending from the body, the rod mounted to telescope in and out of the body with the movement of the piston.

7. The exercise apparatus of claim 1, wherein each of the respective pluralities of resistances devices coupled between each arm and the base each comprises three telescoping cylinders.

8. The exercise apparatus of claim 1, wherein the respective pluralities of resistances devices coupled between each arm and the base are each mounted in a circumferentially spaced relationship about the universal joint for that arm.

9. The exercise apparatus of claim 1, wherein the universal joint connected to each arm comprises a ball joint.

10. The exercise apparatus of claim 1, wherein the base comprises a floor surface.

11. The apparatus of claim 1, wherein the pair of coupling mechanisms each comprise a spacer that extends upward from the base.

12. The exercise apparatus of claim 1 wherein for each arm, each of the respective pluralities of resistance devices is coupled to the base via an upstanding member and corresponding joint assembly that are lower than the first respective elevation at which that arm is coupled to its universal joint.

13. An apparatus, comprising:

a base;

a pair of coupling mechanisms, each comprising a vertical element connected to and extending upward from the base;

a pair of joints, each respectively coupled to an upper portion of one of the pair of coupling mechanisms, wherein each of the pair of joints is entirely elevated above the base by being connected to the vertical element of a respective one of the pair of coupling mechanisms;

a pair of movable arms, each being elongated in a vertical direction relative to the base and comprising a graspable elongated element that is positioned above the base, each arm being respectively coupled to one of the pair of joints at a first respective elevation above the base; and two pluralities of resistance means for providing resistance in response to a horizontal motion of a respective arm by a user, each plurality of the resistance means coupled between a respective arm and the base, wherein each of the two pluralities of resistance means is coupled to the base at an elevation lower than the first respective elevation corresponding to the joint for that arm.

14. The apparatus of claim 13, wherein the pair of joints each comprise two bifurcated portions and two pivot shafts allowing 360 degrees of horizontal movement of a corresponding arm.

15. The apparatus of claim 13, wherein one or more of each of the two pluralities of resistance means is coupled to the base via an upstanding member that extends upward from the base.

16. The apparatus of claim 13, wherein each of the pair of coupling mechanisms comprises one or more spacers.

17. The apparatus of claim 16, wherein the one or more spacers of each of the pair of coupling mechanisms is adjustable to change the first elevation for a corresponding arm.

18. The apparatus of claim 13, wherein each of the arms is adjustable in length.

19. The apparatus of claim 13, wherein each of the two pluralities of resistance means comprises a rod portion.

* * * * *